US006009928A

United States Patent [19]

Wu

[11] Patent Number: 6,009,928

[45] Date of Patent: Jan. 4, 2000

[54] COMPLEX WINDOW HAVING MULTIPLE WINDOW TYPES

[76] Inventor: Yueh-Chi Wu, 10F, No. 110, Ta Ching Street, Kaohsiung, Taiwan

[21] Appl. No.: 08/958,549

[22] Filed: Oct. 29, 1997

[51] Int. Cl.[7] ..... A47H 1/00

[52] U.S. Cl. ..... 160/90; 160/118; 160/127

[58] Field of Search ..... 160/89, 90, 113, 160/115, 118, 127, 201, 214, 223

[56] References Cited

U.S. PATENT DOCUMENTS

| | | | |
|---|---|---|---|
| 2,311,413 | 2/1943 | Persson | 160/89 |
| 2,446,743 | 8/1948 | Davis | 160/90 |
| 2,494,161 | 1/1950 | Blackman | 160/90 |
| 2,771,133 | 11/1956 | Haskell | 160/89 |
| 2,869,187 | 1/1959 | Liebman et al. | 160/90 |
| 3,135,027 | 6/1964 | Squires | 160/90 X |
| 3,219,100 | 11/1965 | Johnston et al. | 160/90 |
| 4,064,653 | 12/1977 | Randall et al. | 49/458 |
| 4,271,631 | 6/1981 | Trout | 49/181 |
| 4,274,468 | 6/1981 | McPhail | 160/90 |
| 4,538,662 | 9/1985 | Tomita | 160/90 |
| 5,379,824 | 1/1995 | Carvalho | 160/90 |

*Primary Examiner*—Daniel P. Stodola
*Assistant Examiner*—Bruce A. Lev
*Attorney, Agent, or Firm*—Pro-Techtor International Services

[57] ABSTRACT

A multiple-style complex window of two uses includes a casing, a push-out window, a slide window and a screen fixed in said casing. The push-out window may be pushed out, and the slide window and the screen may be pushed sidewise to an inside or behind the push-out window. A middle post is provided to separate the push-out window from the slide window and the screen. The push-out window, the slide window and the screen are positioned orderly from the outside to the inside so that the latter two may be slid to behind the push-out window.

2 Claims, 4 Drawing Sheets

COMPLEX WINDOW HAVING MULTIPLE WINDOW TYPES

BACKGROUND OF THE INVENTION

This invention concerns a new-style complex window of two uses, particularly having a push-out window, a slide window with a screen to be independently handled according to the weather, user's preference for adjusting ventilation, temperature and humidity of a room.

Common windows may generally be classified as follows.

1. Slide windows.
2. Push-out windows.
3. Air-tight windows.
4. Fixed windows (for light only).

Each of them has its own function, use and shape, and to be separately applied, so far not to be combined together in a same casing or mixed to be used in a same house or building.

But in point of view of long practical experience, if a same casing have two different kinds of windows, it will be very convenient to be handled according to the weather and user's preference for adjusting ventilation, temperature or humidity of a room.

SUMMARY OF THE INVENTION

This invention has been devised to offer a new-style complex window of the following functions.

1. Having two different windows disposed in a casing for different uses.
2. Having a good draining structure
3. Having an anti-wind drain device for automatically closing a drain hole, preventing air reverse flowing into a room through the window.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
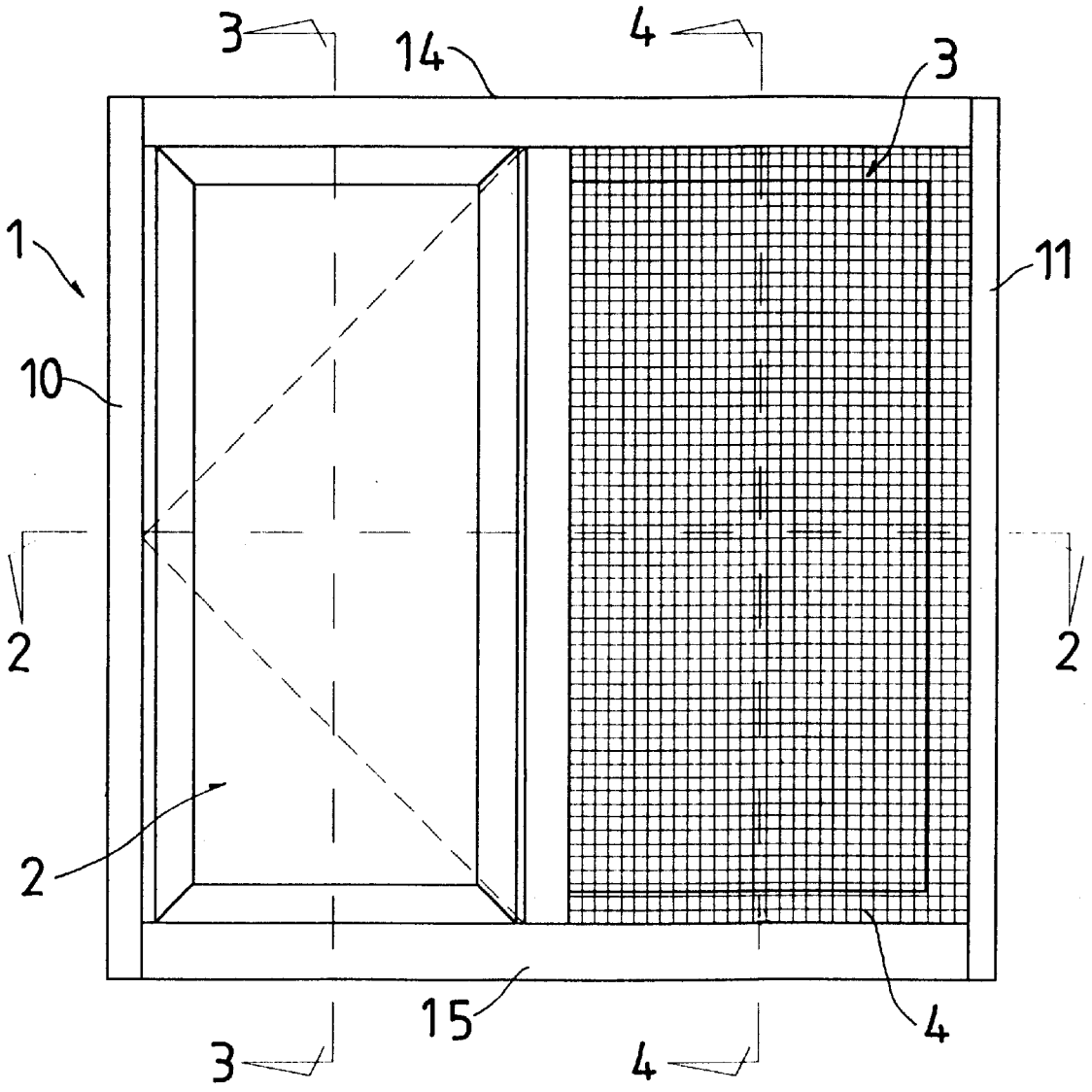
FIG. 1 is a front view of a preferred embodiment of a new-style complex window of two uses in the present invention.

A preferred embodiment of a new-style complex window of two uses in the present invention, as shown in FIG. 1, includes a casing 1 for combining together two different windows, a push-out window 2 and a slide window 3 illustrated as examples in the present invention. But other kinds of windows can also be combined with the push-out one 2 or the slide one 3.

Figure 2:
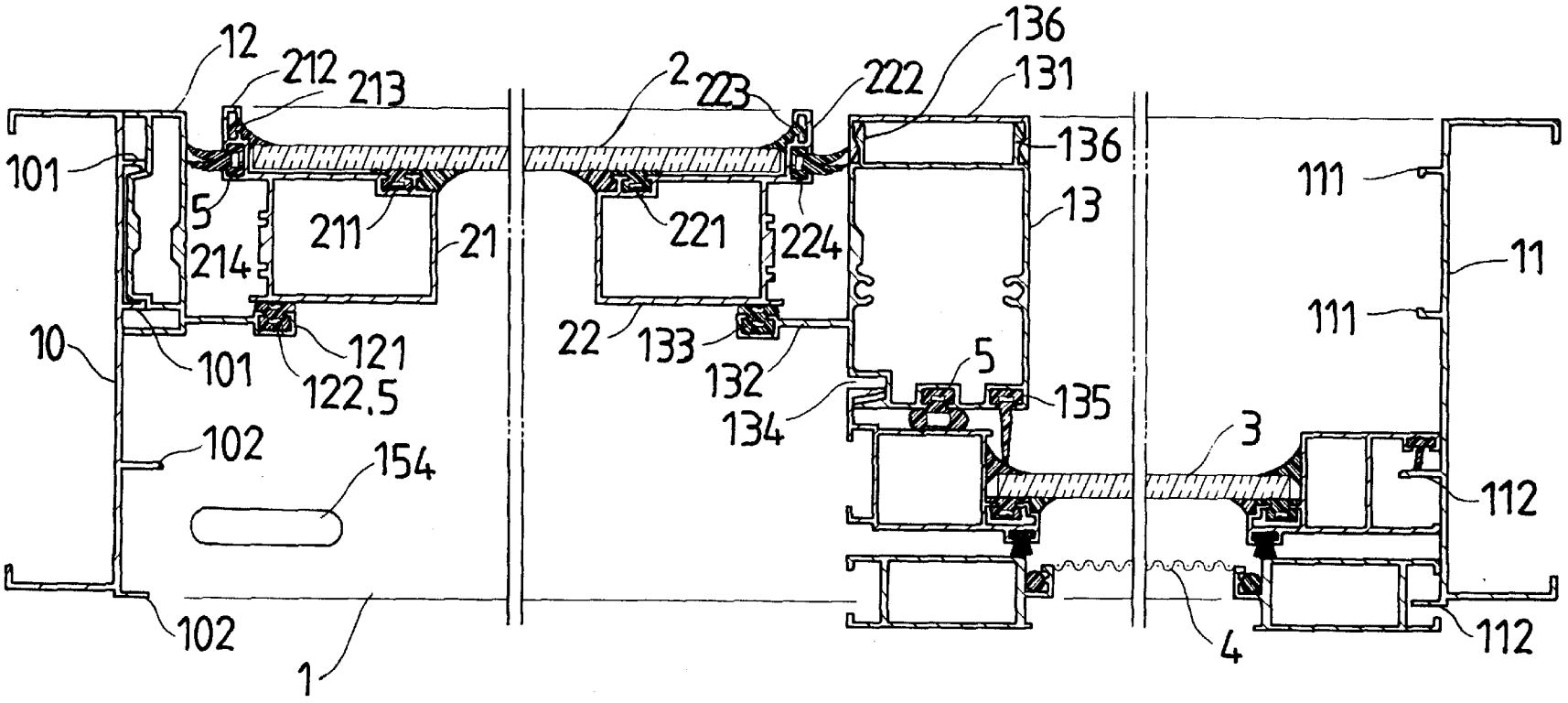
FIG. 2 is a cross-sectional view of line 2—2 in FIG. 1.

The casing 1 includes, as shown in FIG. 2, a left side jamb 10 and a right side jamb 11 of the same structure made of a same injecting mold. The left and the right side jamb 10 and 11 respectively have two L-shaped projecting ridges 101, 111 spaced apart near an outer surface, two securing plates 102, 102; 112, 112 extending upright for assembling the slide window 3 and a window 3 and a screen 4. The left side jamb 10 further has has an auxiliary vertical wall 12 formed for assembling push-out window 2, and the auxiliary wall 12 has a secure plate 121 extending inward and having an opening 122 for inserting a bar spring 5 therein.

The casing 1 further includes a middle post 13 at the point where the two windows 2 and 3 are combined together. The middle post 13 has a flat secure plate 132 extending toward the push-out window 2 and having its outer end formed with an open cavity 133 for inserting a bar spring 5 therein, a groove 134 formed near the inside for the slide window 3 to fit therein when the window 3 is closed, and at least a cavity 135 formed to open to the inside and in line to the groove 134 for inserting a bar spring 5 therein, and two parallel ridges 136, 136 extending outside for a decorative plate 131 to combine with.

Figure 3:
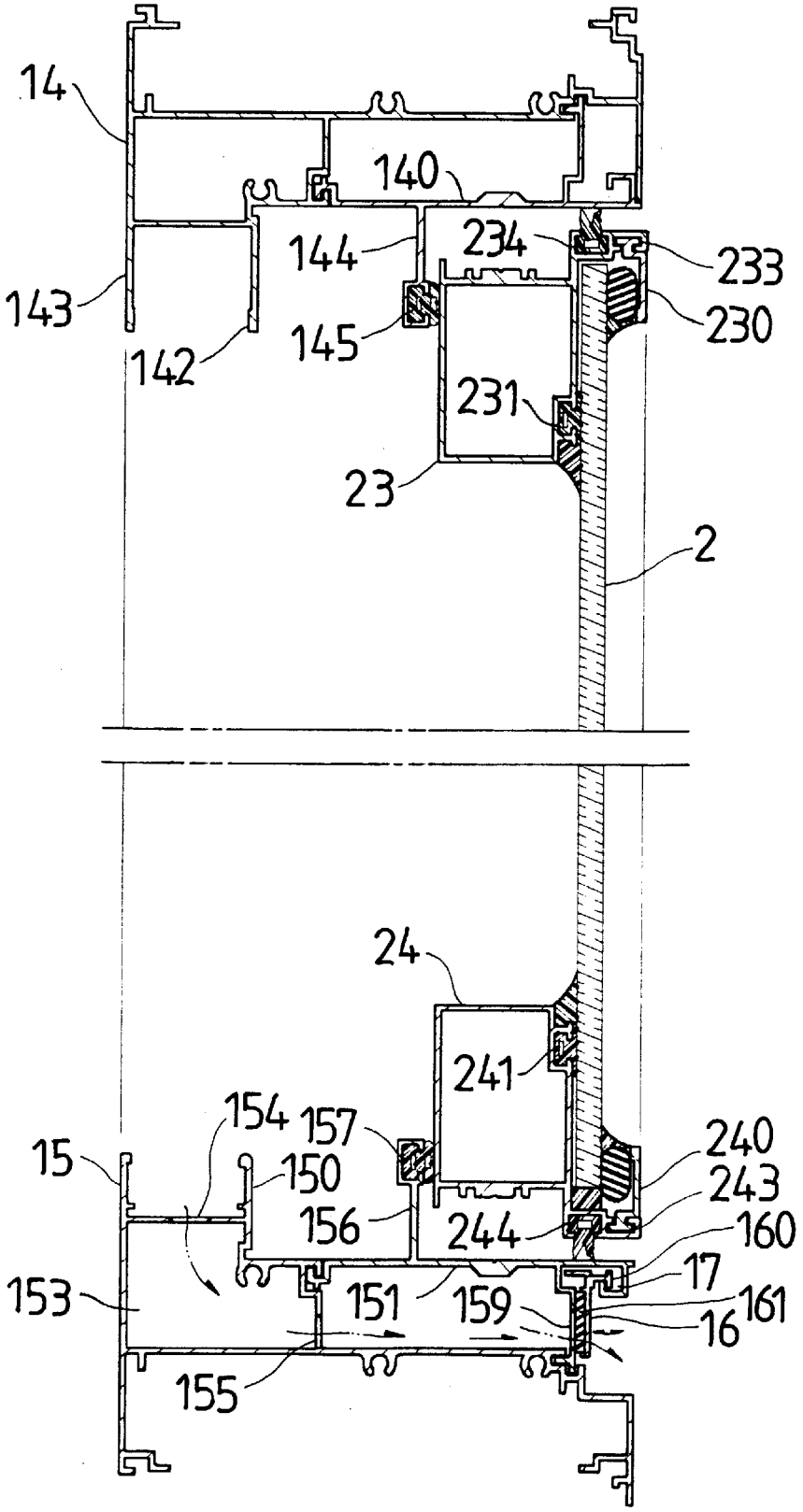
FIG. 3 is a cross-sectional view of line 3—3 in FIG. 1.
Figure 4:
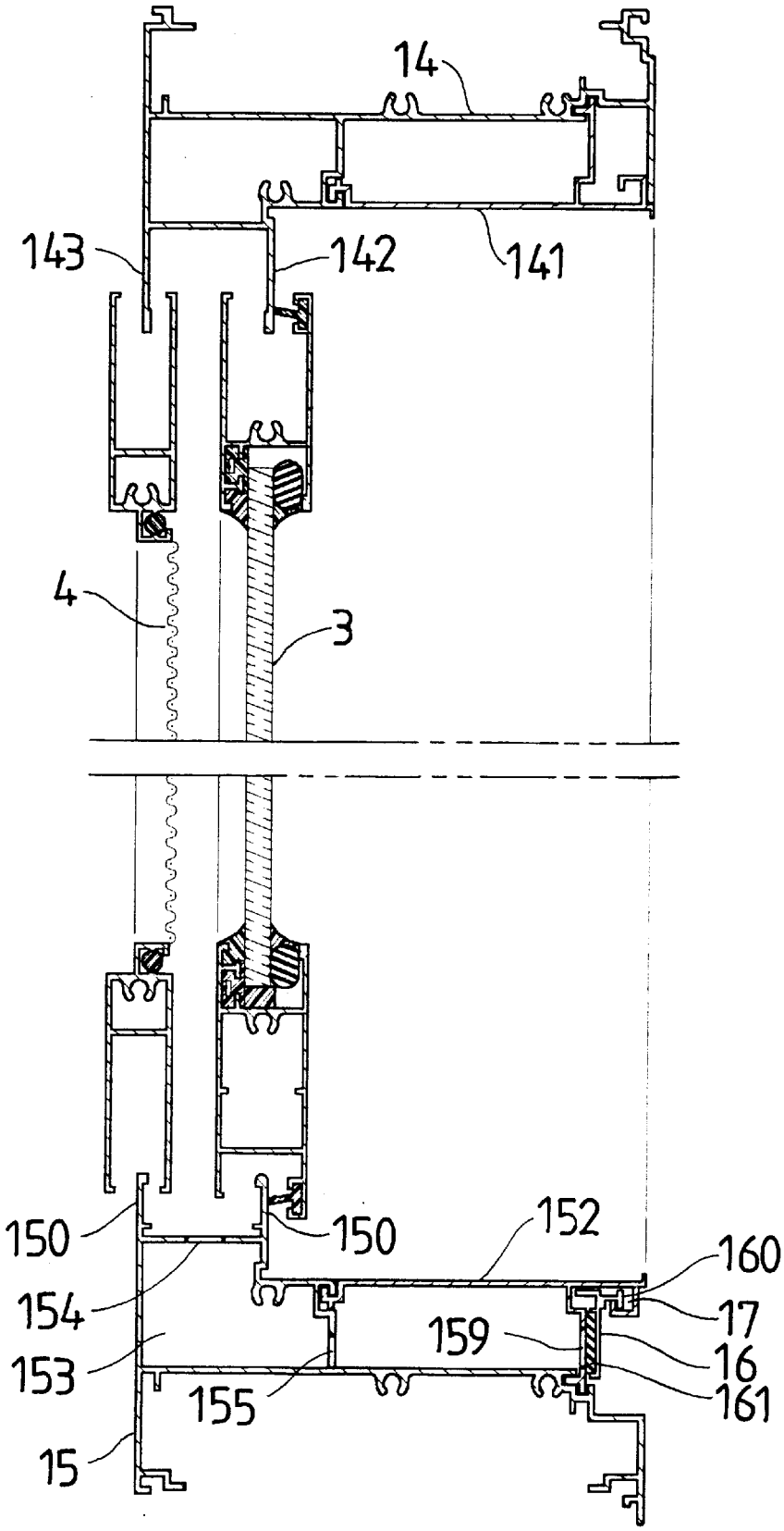
FIG. 4 is a cross-sectional view of line 4—4 in FIG. 1.

The casing 1 further has an top side rail 14, as as shown in FIG. 3, which has two parallel secure plates 142, 143 near the inside for holding upper sides of the slide window 3 and the screen 4, and a left horizontal member 140 near the outside, a secure plate 144 extending down from the left horizontal member 140, a cavity 145 formed at an end of the secure plate 144 to open to the outside for inserting a bar spring 5 therein, and a right horizontal member 141 shown in FIG. 4 having a flat lower surface of a different structure from the left horizontal member 140.

The casing 1 further has a bottom side rail 15, as shown in FIGS. 3 and 4, which has two parallel guide members 150, 150 near the inside for the slide window 3 and the screen 4 to sit and slide thereon, a hollow drain way 153 formed under said two guide members 150, 150 with a separating wall with a drain hole 155, an auxiliary left horizontal member 151, a vertical secure plate 156 formed to extend up from the left horizontal member 151 and having a cavity 157 formed at an outer end to open to the inside for inserting a bar spring 5 therein, an auxiliary right horizontal member 152 having a flat upper surface. The left and the right auxiliary horizontal member 151 and 152 respectively have at least a drain hole 159 in the outside for water coming from the drain hole 154 and through a through hole 155 in a wall near the outside to flow out.

The bottom side rail 15 further has a cavity 17 respectively formed on the drain hole 159 of the left and the right auxiliary horizontal member 151 and 152 and opening to the inside with an outer bent-up end for hooking an anti-wind plate 16 to let the same plate 16 to swing in a limited angle, and an elastic plate 161 deposited inside the anti-wind plate 16 to close up the drain hole 159, a hook ridge 160 formed at an upper end of the the anti-wind plate 16 and fitting in the cavity 17 to secure the plate 16. Then the anti-wind plate 16 may swing according to alteration of the center of gravity so that when wind is stronger than the gravity and than that of the drain way 153, the anti-wind plate 16 automatically closes the drain hole 159. Thus it can prevent air reverse flowing and subsequent noises caused by it.

FIGS. 2 and 3 show the structure of the push-out window 2, which has a left stile 21 and a right stile 22 of the same structure but in a contrast position, made of a same mold. The left stile 21 is formed of a cavity 211 on an inner edge opening to the outside and a side plate 212 at an outer end with two parallel openings 213, 214 facing to opposite directions. The right stile 22 also has a cavity 221, a side plate 222, and two parallel openings 223, 224 in the contract positions to the left stile 21.

The push-out window 2 further has a top horizontal rail 23 and a bottom rail 24 of the same structure of the left and the right stile 21 and 22 made of a same mold, so the top and the right horizontal rail 23 and 24 respectively have two cavities 231 and 241, and two side plates forming two pairs of parallel openings 233, 234; 243, 244. But the openings 233, 243 respectively have a top and a bottom auxiliary horizontal member 230 and 240 fixed therein for assembling a glass of the window 2.

The slide window 3 is positioned on the outer guider 150 of the bottom side rail 15 of the casing 1, and the screen 4 is positioned on the inside guider 150 of the bottom side rail 15. Both the slide window 3 and the screen 4 can be pulled sidewise to the inside of the push-out window 2 so that the push-out window 2, the slide window 3 and the screen 4 are positioned orderly from the outside to the inside in the casing 1.

The complex window according to the invention has more than two kinds of uses handled by need and choice of a person, depending on the season for adjusting air volume to come through the window and thus room temparature accordingly.

In addition, in case that wind has a larger pressure than that of the drain way 153 of the bottom side rail 15, the anti-wind plate 16 automatically swing to close up the drain hole 159 so as to prevent air reverse flowing and noises and thus subsequent water splashing into a room through the window. If wind is weaker, the anti-wind plate 16 automatically leaves the drain hole 159 owing to its own gravity so that water can flow through the drain hole 159 out of a room. As wind incessantly presses the window, the anti-wind plate 16 automatically swing to open and close the drain hole 159 according to wind pressure so that the window in the invention may not produce noises or splashing of rain water into a room through it.

While the preferred embodiment of the invention has been described above, it will be recognized and understood that various modifications may be made therein and the appended claims are intended to cover all such modifications which may fall within the spirit and scope of the invention.

What is claimed is:

1. A complex window comprising:

a casing, a middle post, a push-out window, a slide window and a screen assembled within said casing;

said casing having a left stile and a right stile, said left and said right stile respectively having two L-shaped ridges spaced apart near an outside and two secure plates spaced apart to receive a side of said slide window and of said screen, an auxiliary vertical wall combined with said two L-shaped ridges to support said push-out window and having a secure plate formed with a cavity opening to the outside at an outer end;

said middle post positioned in said casing to separate said push-out window and said slide window, and having a secure plate extending from said post toward said push-out window, an opened cavity facing the outside, a groove formed in an inner side to receive a side of said slide window when said slide window is closed, and at least two cavities formed in a bottom side facing the inside;

said casing further having a top side rail provided with two secure plates extending down and spaced apart near the inside to receive said slide window and said screen, a left auxiliary horizontal wall and a right auxiliary horizontal wall near the outside and separated by said middle post, said left auxiliary horizontal wall having a secure plate extending down vertically, said secure plate having a cavity formed at an outer end and opening to the outside, said right auxiliary horizontal plate having a flat bottom surface;

said casing further having a bottom side rail provided with two parallel guiders on an upper surface near the inside respectively for said slide window and said screen to slide along, a drain channel formed between said two parallel guiders, a first drain hole in a separating wall between said drain channel and said two guiders, and a second drain hole in an outer wall of said drain channel;

said bottom side rail further assembled with a right auxiliary horizontal member on an upper surface separated from said left auxiliary horizontal member by said middle post, a cavity formed on said second drain hole with an open front side adapted to receive an anti-wind plate so that the anti-wind plate rotates through a limited angle;

said push-out window, said slide window and said screen are positioned in order from the outside to the inside, said slide window and said screen may be moved sideways to behind or the inside of said push-out window;

said push-out window having a top rail, a bottom rail, a left stile and a right stile all having the same structure, wherein a cavity with an opening facing the outside is provided in an inner side of an outer surface of each said rail and said stile, with a side plate extending out from said outer surface and two openings facing to opposite directions, said two openings of said side plates of said top and said bottom rail respectively fitted with horizontal members for assembling a glass of said window.

2. The complex window as claimed in claim 1, wherein:

said complex window further includes an anti-wind plate with an elastic plate fitted on an inner surface, and a projecting hook formed in an upper end to hook in said cavity of said bottom side rail so that said anti-wind plate may swing through a limited angle.

* * * * *